US005230991A

United States Patent [19]

Nagaoka et al.

[11] Patent Number: 5,230,991

[45] Date of Patent: Jul. 27, 1993

[54] METHOD FOR PROCESSING SILVER HALIDE COLOR PHOTOGRAPHIC LIGHT-SENSITIVE MATERIALS

[75] Inventors: Shinsaku Nagaoka; Shigeharu Koboshi, both of Hino, Japan

[73] Assignee: Konica Corporation, Tokyo, Japan

[21] Appl. No.: 778,526

[22] Filed: Oct. 18, 1991

[30] Foreign Application Priority Data

Oct. 23, 1990 [JP] Japan ..... 2-285471

[51] Int. Cl.[5] ..... G03C 7/42

[52] U.S. Cl. ..... 430/393; 430/460; 430/490; 430/933

[58] Field of Search ..... 430/393, 460, 490, 933

[56] References Cited

U.S. PATENT DOCUMENTS 4,374,922 2/1983 Ohbayashi et al. ..... 430/384

4,966,834 10/1990 Ishikawa et al. ..... 430/393

5,102,778 4/1992 Nakamura ..... 430/460

*Primary Examiner*—Hoa Van Le

*Attorney, Agent, or Firm*—Frishauf, Holtz, Goodman & Woodward

[57] ABSTRACT

A method for processing a silver halide color photographic light-sensitive material is discloseed. The method comprises the steps of developing a silver halide color photographic light-senaitive material which comprises silver halide grains substantially consisting of silver chloride, whith acolor developer, and bleach-fixing said deveoped light-sensitive material with a bleach-fixer containing a water soluble bromide salt in an amount of from 0.01 mol/l to 1.0 mol/l and having a pH value of from 6.5 to 8.5 in a tank in whic said bleach fixer has a surface area opening to air of from 8 $cm^2/l$ to 100 $cm^2/l$.

12 Claims, No Drawings

METHOD FOR PROCESSING SILVER HALIDE COLOR PHOTOGRAPHIC LIGHT-SENSITIVE MATERIALS

FIELD OF THE INVENTION

The present invention relates to a method for processing silver halide color photographic light-sensitive materials hereinafter occasionally referred to as a light-sensitive material), more particularly to a method for processing silver halide color photographic light-sensitive materials excellent in preservability of a processing solution and improved in anti-corrosive property of a processing solution.

BACKGROUND OF THE INVENTION

In the photographic processing to obtain color images by processing imagewise-exposed light-sensitive materials, there are generally provided, after color developing, desilverization of the metal silver formed and subsequent processes of washing and stabilizing or stabilizing which functions as washing concurrently.

These light-sensitive materials are processed in an automatic processor installed in individual processing laboratories. And as a part of customer service, processing laboratories are required to process and return light-sensitive materials to customers within the same day on which these are brought in for development. This tendency is growing recently, and there has come to be demanded return of light-sensitive materials within hours after being brought in. Under the circumstances, further improvements in the rapid processing technology are increasingly required.

To meet such requirements, Eastman Kodak Company, for example, recently proposed Process RA-4, a rapid processing for color paper which processes a light-sensitive material in 3 minutes at 35° C. (comprising 3 processes of 45-second color developing, 45-second bleach-fixing and 90-second stabilizing).

Meanwhile, conventional techniques for rapid processing can be classified into three categories:

1) techniques to improve light-sensitive materials,
2) techniques based on physical means in processing, and
3) techniques to improve the composition of processing solutions used in processing.

In the above category 1), there have been proposed (1) improvements in silver halide composition, for example, a technique for preparing silver halide fine grains described in Japanese Pat. O.P.I. Pub. No. 77223/1976 and a technique to prepare low silver bromide content silver halide described in Japanese Pat. O.P.I. Pub. No. 18142/1983 and Japanese Pat. Exam. Pub. No. 18939/1981; (2) use of additives, for example, a technique to add in light-sensitive materials a 1-aryl-3-pyrazolidone having a specific structure as described in Japanese Pat. O.P.I. Pub. No. 64339/1981 and a technique to add in light-sensitive materials 1-aryl pyrazolidones described in Japanese Pat. O.P.I. Pub. Nos. 144547/1982, 50534/1983, 50535/1983 and 50536/1983; (3) techniques to employ rapid reaction couplers, for example, a technique to use rapid reaction yellow couplers described in Japanese Pat. Exam. Pub. No. 10783/1976 and Japanese Pat. O.P.I. Pub. Nos. 123342/1975, 102636/1976; and (4) techniques to form thin photographic structural layers, for example, a technique to form thin photographic structural layers described in Japanese Pat. O.P.I. Pub. No. 65040/1987.

The above category 2) includes techniques for stirring processing solutions, for example, a stirring technique for processing solutions described in Japanese Pat. O.P.I. Pub. No. 180369/1987.

With respect to the category 3), there are known (1) techniques to use developing accelerators; (2) techniques to use high concentration color developing agents; and (3) techniques to reduce a halogen ion concentration, particularly a bromine ion concentration in developer.

Among these rapid processing techniques, one which can provide an excellent rapid processability is a technique to use a light-sensitive material comprised of silver halide grains having high silver chloride content, which falls under the above category 1), embodiments of this technique can be seen, for example, Japanese Pat. O.P.I. Pub. Nos. 95345/1983, 19140/1985 and 95736/1983.

However, the rapid processing of a light-sensitive material containing silver halide grains having high silver chloride content has a drawback of causing unevenness in magenta in a colored portion, not a color stain occurring in an unexposed portion, when a light-sensitive material is processed in a solution having a bleaching capability subsequently to color developing.

Formation of magenta stain in an unexposed portion is observed at times even in light-sensitive materials containing silver bromide as the main component, when these are bleach-fixed immediately after color developing. And as a measure to solve such a problem, there is known to add a compound described below in a bleach or bleach-fixer containing EDTA Fe as the principal component of the bleaching agent.

For example, a technique to use L-ascorbic acid and 2-hydroxy-4-phenyltetronimide is disclosed in British Pat. No. 1,131,096, a technique to use morpholine in British Pat. No. 1,131,335, a technique to use para-aminophenol in British Pat. No. 1,133,500, a technique to employ polyalkylene polyamine in Japanese Pat. O.P.I. Pub. No. 136031/1975, and a technique to add sulfites to a bleaching solution containing EDTA.Fe as a principal component of the bleaching agent.

These techniques seem to be effective on light-sensitive materials containing silver bromide, but ineffective in preventing uneven magenta dye formation in a colored portion of a light-sensitive material in which silver chloride is used.

As a method to prevent such uneven magenta dye formation in a light-sensitive material whose main silver halide composition is silver chloride, Japanese Pat. O.P.I. Pub. No. 196662/1987 discloses a technique to remove benzyl alcohol from a color developer when a two-equivalent magenta coupler specified in the specification is used. But this method has no effect in preventing the uneven magenta dye formation in a colored portion.

The uneven magenta dye formation is attributed to a poor development stopping property of a bleach-fixer for high silver chloride content light-sensitive materials. Therefore, this problem has been prevented by keeping the pH of a bleach-fixer less than 6.5 and adding ammonium bromide thereto.

In this case, however, the low pH of less than 6.5 brings a problem of impairing the preservability of a bleach-fixer. For example, a bleach-fixer having a pH of less than 6.3 is placed on the market as a low replenishing type, but its use is limited to large-scale processing laboratories for its insufficient preservability. On the other hand, in case of a small-scale processing or low replenishment processing, precipitation of sulfur or sulfides in bleach-fixer is liable to occur. And once it occurs, light-sensitive materials in the solution are stained with precipitated sulfur or sulfides, the bleach-fixer's capability is lowered, and troubles such as poor desilverization and poor color formation are caused. In case of a heavy precipitation of sulfur or sulfides, processing becomes unable to continue without renewing the processing solution, and tanks and racks need to be cleaned. In addition, tar is formed in the bleach-fixer.

Further, addition of bromides to a bleach-fixer of low pH increases corrosiveness of the solution, causing rust on the surface of tanks or racks which contact with the solution. Though such rusting can be avoided by the use of titanium or SUS316L containing less carbon as the material of tanks and racks, it raises the equipment cost as compared with SUS316 which is used commonly.

Moreover, the opening area of a bleach-fixing tank has a large effect on processability as well as properties of a processing solution. An opening area smaller than a specific value hinders the air oxidation of a bleaching agent, causing processing failure. And an opening area larger than a specific value leads to an excessive decomposition of a preservative by air oxidation, and thereby preservability of a processing solution is deteriorated and corrosion of tanks and racks is accelerated.

SUMMARY OF THE INVENTION

The object of the present invention is to provide a method for processing silver halide color photographic light-sensitive materials, which does not cause unevenness in magenta in colored portions, has a good preservability and thereby forms little tar, provides a stable processing free from desilverization failure and recoloring failure, and exhibits a good anticorrosive property, even when a silver halide color photographic light-sensitive material virtually comprised of silver chloride is subjected to bleach-fixing.

The method for processing a silver halide color photographic light-sensitive material of the invention comprises steps of developing a silver halide color photographic light-sensitive material which comprises silver halide grains substantially consisting of silver chloride, with a color developer, and bleach-fixing said developed light-sensitive material with a bleach-fixer containing a water soluble bromide salt in an amount of from 0.01 mol/l to 1.0 mol/l and having a pH value of from 6.5 to 8.5 in a tank in which said bleach-fixer has a surface area opening to are of from 8 $cm^2/l$ to 100 $cm^2/l$.

DETAILED DESCRIPTION OF THE INVENTION

The amount of bromides, for example, ammonium bromide, used in a bleach-fixer of the invention is generally 0.01 to 1.0 mol/l, preferably 0.05 to 0.5 mol/l, and especially 0.08 to 0.3 mol/l.

In the invention, there may be used any of known bromine-ion-releasing compounds such as $NH_4Br$, KBr, NaBr, LiBr, RbBr, CsBr, $MgBr_2$ and $CaBr_2$, but $NH_4Br$, KBr and NaBr are preferred.

The pH of a bleach-fixer used in the invention is within a range from 6.5 to 8.5, preferably from 6.5 to 8.0.

The processing is carried out at a temperature not higher than 80° C., preferably at a temperature not higher than 55° C. while preventing evaporation. The bleach-fixing time is preferably not more than 120 seconds, especially 5 to 90 seconds, in order to bring out the best effect of the invention.

The replenishing rate of a bleach-fixer is preferably 20 to 100 $ml/m^2$; particularly, a replenishment of 25 to 60 $ml/m^2$ is much effective and low in replenishment as well, and helps improvement in anticorrosive property.

The bleach-fixer of the invention has a high resistance against air oxidation; the opening area of a bleach-fixer tank is preferably 13 to 80 $cm^2/l$, and that of 25 to 50 $cm^2/l$ gives particularly favorable results.

For the bleach-fixer used in the invention, suitable bleaching agents are metal complex salts of organic acids; namely, organic acids such as aminopolycarboxylic acids, oxalic acid and citric acid, coordinated with metal ions such as iron, cobalt and copper ions. In forming such metal complex salts, particularly preferred organic acids are aminopolycarboxylic acids. And these aminopolycarboxylic acids may be any of alkali metal salts, ammonium salts and water-soluble amine salts. Typical examples of such organic acids are illustrated below.

(1) Ethylenediaminetetracetic acid
(2) Diethylenetriaminepentacetic acid
(3) Ethylenediamine-N-(β-hydroxyethyl)-N,N',N'-triacetic acid
(4) Propylenediaminetetracetic acid
(5) Nitrilotriacetic acid
(6) Cyclohexanediaminetetracetic acid
(7) Iminodiacetic acid
(8) Dihydroxyethyl glycine citric acid (or tartaric acid)
(9) Ethyl ether diamine tetracetic acid
(10) Glycol ether diamine tetracetic acid
(11) Ethylenediaminetetrapropionic acid
(12) Phenylenediaminetetracetic acid
(13) Disodium ethylenediaminetetracetate
(14) Tetra(trimethyl ammonium) ethylenediaminetetracetate
(15) Tetrasodium ethylenediaminetetracetate
(16) Pentasodium diethylenetrianminepentacetate
(17) Sodium ethylenediamine-N-(β-hydroxyethyl)-N,N',N'-triacetate
(18) Sodium propylenediaminetetracetate
(19) Sodium nitrilotriacetate
(20) Sodium cyclohexanediaminetetracetate The above bleaching agents are used in amounts of 5 to 450 g/l, preferably 20 to 250 g/l and especially 25 to 150 g/l of bleach-fixer. Among these bleaching agents, the particularly preferred are ferric complex salts of ethylenediaminetetracetic acid, diethylenetriaminepentacetic acid, glycol ether diamine tetracetic acid and cyclohexanediaminetetracetic acid. Besides such a bleaching agent, the bleach-fixer contains in its liquid composition a fixing agent for silver halide, and a sulfite or sulfite-ion-releasing compound as a preservative if necessary.

Preferable examples of the sulfite and sulfite-ion-releasing compound used in the bleach-fixer of the invention include potassium sulfite, sodium sulfite, ammonium sulfite, ammonium hydrogensulfite, potassium hydrogensulfite, sodium hydrogensulfite, potassium metabisulfite, sodium metabisulfite and ammonium metabisulfite. As other examples, there are included those expressed by the general formula [B-1]or [B-

2]given on page 60 of the specification of Japanese Pat. O.P.I. Publication No. 295258/1989.

In view of preservability of a solution, it is desirable that these sulfites or sulfite-ion-releasing compounds be used at a concentration of less than 0.03 mol per liter of bleach-fixer as sulfite ions. Further, from the viewpoint of preventing tar formation and recoloring failure, the addition amount of these compounds is preferably 0.03 to 0.30 mol per liter, especially 0.06 to 0.20 mol per liter of bleach-fixer as sulfite ions.

The fixing agent for silver halide contained in the bleach-fixer is a compound used in an ordinary fixing process to form a water-soluble complex salt by reaction with silver halide. Typical examples thereof include thiosulfates such as potassium thiosulfate, sodium thiosulfate, ammonium thiosulfate; thiocyanates such as potassium thiocyanate, sodium thiocyanate, ammonium thiocyanate; thioureas; and thioethers. Though these fixing agents can be employed in a range from 5 g/l to a maximum soluble amount, these are generally used in a range from 70 to 250 g/l.

The bleach-fixer may contain, singly or in combination, pH buffers such as boric acid, borax, sodium hydroxide, potassium hydroxide, sodium carbonate, potassium carbonate, sodium bicarbonate, potassium bicarbonate, acetic acid, sodium acetate and ammonium hydroxide. The bleach-fixer may also contain fluorescent brighteners, defoamers and surfactants. Further, there may be contained, according to a specific requirement, preservatives such as bisulfite adducts of hydroxylamine, hydrazine and aldehydes; organic chelating agents such as aminopolycarboxylic acids; stabilizers such as nitro-alcohols, nitrates; and organic solvents such as methanol, dimethyl sulfamide, dimethyl sulfoxide.

A high pH value of the bleach-fixer causes another problem in addition to unevenness in magenta.

In general, a large amount of ammonia is contained in a bleach-fixer in the form of ammonium salt. When the pH of a bleach-fixer becomes lager than 6.5, ammonia begins to vaporize, making the pH of the solution unstable. In addition, an offensive smell of ammoina causes a problem with respect to environmental sanitation.

This can be solved by making sodium and/or potassium ions in the bleach-fixer more than 25% of the total cations contained therein. That is, vaporization of ammonia is prevented by making the content of sodium and potassium ions 25 mol % or more of the total cations in the solution; as a result, uneven processing and environmental pollution due to vaporization of ammonia can be avoided. To bring out a better effect of the invention, it is preferable that the content of sodium and potassium ions be not less than 50 mol % of the total cations contained therein.

The bleach-fixer of the invention may use various bleaching accelerators described, for example, in Japanese Pat. O.P.I. Pub. Nos. 280/1971, 42349/1974, 71634/1979, Japanese Pat. Exam. Pub. Nos. 8506/1970, 8836/1975, 556/1971, 9854/1978 and Belgian Pat. No. 770,910.

The processing temperature in a bleach-fixing bath is not more than 80° C. and lower than the processing temperature in a color developing bath by 3° C. or more, desirably 5° C. or more; preferably, the bleach-fixing is carried out at a temperature of not more than 55° C. under the control of vaporization.

Silver halide grains used in a light-sensitive material, to which the present invention is applied, substantially consisting of silver chloride. The term substantially "consisting of silver chloride" used here indicates silver halide grains containing at least 95 mol %, desirably more than 98 mol %, more desirably more than 99 mol %, and most desirably more than 99.3 mol % of silver chloride.

A silver halide emulsion containing the above silver halide grains substantially consisting of silver chloride may contain silver bromide and/or silver iodide as silver halide compositions other than silver chloride. In this case, the content of silver bromide is not more than 5 mol %, preferably not more than 2 mol %, and especially not more than 1 mol %.

In a color developer used in the invention, there are advantageously employed, instead of hydroxylamine which is commonly used as a preservative, organic preservatives such as hydroxylamine derivatives described in Japanese Pat. O.P.I. Pub. Nos. 146043/1988, 146042/1988, 146041/1988, 146040/1988, 135938/1988, 118748/1988; and hydroxamic acids, hidrazines, hydrazides, phenols, α-hydroxyketones, α-aminoketones, sugars, monoamines, diamines, quaternary ammonium salts, nitroxy radicals, alcohols, oximes, diamide compounds and condensed ring type amines, which are described in Japanese Pat. O.P.I. Pub. No. 62639/1989.

To heighten the effect of the invention, it is preferable that the compound expressed by the following Formula I or hydrazines be contained in the color developer.

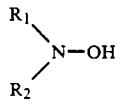

Formula I

In the formula, $R_1$ and $R_2$ each represent an alkyl group or a hydrogen atom, provided that both $R_1$ and $R_2$ are not hydrogen atoms concurrently. $R_1$ and $R_2$ may form a ring.

In Formula I, $R_1$ and $R_2$ independently represent an alkyl group or a hydrogen atom but not hydrogen atoms concurrently; the alkyl groups represented by $R_1$ or $R_2$ may be the same or different and are preferably alkyl groups of 1 to 3 carbon atoms, respectively. The alkyl group represented by $R_1$ or $R_2$ may have a substituent. Further, $R_1$ and $R_2$ may bond with each other to form a ring; examples thereof include heterocycles such as piperidine and morpholine.

As the substituent of the groups of $R_1$ or $R_2$, an alkoxy group, hydroxy group, a carboxyl group, a sulfonic group or a phophoric group, particularly, an alkoxy group, sulfonic group or a phosphoric group is preferable. Among these compounds, ones having higher water solubility are preferable.

While typical examples of the hydroxylamine compounds represented by Formula I can be seen in U.S. Pat. Nos. 3,287,125, 3,293,034 and 3,287,124, particularly preferred one are illustrated below.

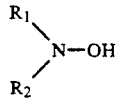

| Illustrated compound No. | $R_1$ | $R_3$ |
|---|---|---|
| (I-1) | $-C_2H_5$ | $-C_2H_5$ |
| (I-2) | $-CH_3$ | $-CH_3$ |
| (I-3) | $-C_3H_7(n)$ | $-C_3H_7(n)$ |
| (I-4) | $-C_3H_7(i)$ | $-C_3H_7(i)$ |
| (I-5) | $-CH_3$ | $-C_2H_5$ |

-continued

| | | |
|---|---|---|
| (I-6) | $-C_2H_5$ | $-C_3H_7(i)$ |
| (I-7) | $-CH_3$ | $-C_3H_7(i)$ |
| (I-8) | $-H$ | $-C_2H_5$ |
| (I-9) | $-H$ | $-C_3H_7(n)$ |
| (I-10) | $-H$ | $-CH_3$ |
| (I-11) | $-H$ | $-C_3H_7(i)$ |
| (I-12) | $-C_2H_5$ | $-C_2H_4OCH_3$ |
| (I-13) | $-C_2H_4OH$ | $-C_2H_4OH$ |
| (I-14) | $-C_2H_4SO_3H$ | $-C_2H_5$ |
| (I-15) | $-C_2H_4COOH$ | $-C_2H_4COOH$ |
| (I-16) | 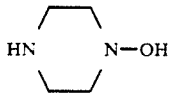 | |
| (I-17) | 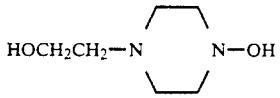 | |
| (I-18) | 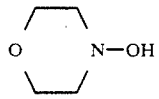 | |
| (I-19) | 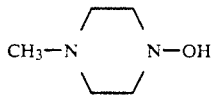 | |

| Illustrated compound No. | $R_1$ | $R_2$ |
|---|---|---|
| (I-20) | $-CH_3$ | $-C_2H_4OCH_3$ |
| (I-21) | $-C_2H_4OCH_3$ | $-C_2H_4OCH_3$ |
| (I-22) | $-C_2H_4OCH_2H_5$ | $-C_2H_4OC_2H_5$ |
| (I-23) | $-C_3H_6OCH_3$ | $-C_3H_6OCH_3$ |
| (I-24) | $-C_2H_5$ | $-C_2H_4OC_2H_5$ |
| (I-25) | $-C_3H_7$ | $-C_2H_4OCH_3$ |
| (I-26) | $-CH_3$ | $-C_2H_4OC_2H_5$ |
| (I-27) | $-CH_3$ | $-CH_2OCH_3$ |
| (I-28) | $-C_2H_5$ | $-CH_2OC_2H_5$ |
| (I-29) | $-CH_2OCH_3$ | $-CH_2OCH_3$ |
| (I-30) | $-C_2H_5$ | $-C_2H_4OC_3H_7$ |
| (I-31) | $-C_3H_6OC_3H_7$ | $-C_3H_6OC_3H_7$ |
| (I-32) | $-C_2H_4SO_3H$ | $-C_2H_4SO_3H$ |
| (I-33) | $-C_2H_4PO_3H_2$ | $-C_2H_4PO_3H_2$ |
| (I-34) | 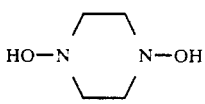 | |

These compounds are generally employed in the forms of free amines, hydrochlorides, sulfates, p-toluenesulfonates, oxalates, phosphates or acetates.

The concentration of the compound of Formula I in the color developer is usually 0.2 to 50 gl, preferably 0.5 to 30 g/l, and especially 1 to 15 g/l.

While the compound represented by Formula I can be used in combination with an organic preservative and hydroxylamine which are commonly used, it is preferable to avoid use of hydroxylamine for a better developing property.

The compound represented by the following Formula II is preferably used in the color developer, because it enhances the color developer's resistance against air oxidation and scarcely exerts an adverse effect even when mixed in the bleach-fixer.

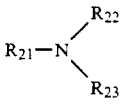

Formula II

In the formula, $R_{21}$ represents a hydroxyalkyl group having 2 to 6 carbon atoms; $R_{22}$ and $R_{23}$ each represent a hydrogen atom, an alkyl group of 1 to 6 carbon atoms, a hydroxyalkyl group of 2 to 6 carbon atoms, a benzyl group, or a formula

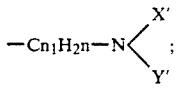

$n_1$ in the above formula is an integer of 1 to 6; X' and Y' each represent a hydrogen atom, an alkyl group of 1 to 6 carbon atoms or a hydroxyalkyl group of 2 to 6 carbon atoms.

Preferred examples of the compound represented by Formula II are as follows:

(II-1) Monoethanolamine
(II-2) Diethanolamine
(II-3) Triethanolamine
(II-4) Di-isopropanolamine
(II-5) 2-Methylaminoethanol
(II-6) 2-Ethylaminoethanol
(II-7) 2-Dimethylaminoethanol
(II-8) 2-Diethylaminoethanol
(II-9) 1-Diethylamino-2-propanol
(II-10) 3-Diethylamino-1-propanol
(II-11) 3-Dimethylamino-1-propanol
(II-12) Isopropylaminoethanol
(II-13) 3-Amino-1-propanol
(II-14) 2-Amino-2-methyl-1,3-propanediol
(II-15) Ethylenediamine-tetrakispropanol
(II-16) Benzyl diethanolamine
(II-17) 2-Amino-2-(hydroxymethyl)-1,3-propanediol The above compounds represented by Formula II are used in a range from 1 to 100 g/l, preferably 2 to 30 g/l of dolor developer for the purpose of preventing air oxidation.

Color developing agents used in the color developer are preferably p-phenylenediamine-type compounds having a water-solubilizing group. And at least one water-solubilizing group is present on the amino group or benzene nucleus of p-phenylenediamine. Preferable examples of such water-solubilizing groups are as follows:

$-(CH_2)n\text{-}CH_2OH$, $-(CH_2)m\text{-}NHSO_2\text{-}(CH_2)n\text{-}CH_3$, $-(CH_2)m\text{-}O\text{-}(CH_2)n\text{-}CH_3$, $-(CH_2CH_2O)nCmH_{2m+1}$ (m and n are each an integer zero or more), —COOH and $-SO_3H$.

Next, suitable color developing agents are illustrated.

(Illustrated color developing agents)

-continued
(A-1)
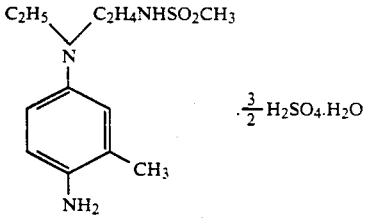
(A-2)
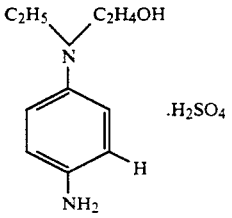
(A-3)
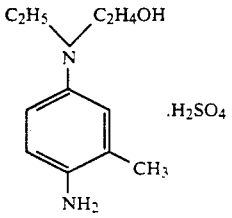
(A-4)
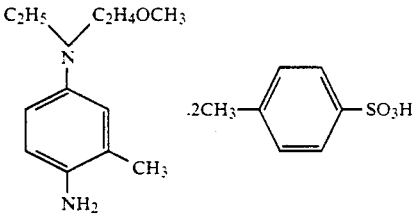
(A-5)
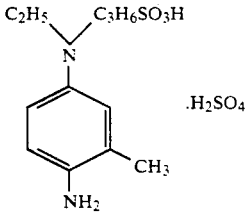
(A-6)
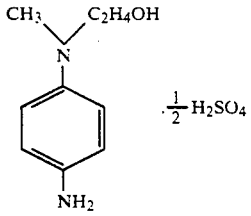
(A-7)
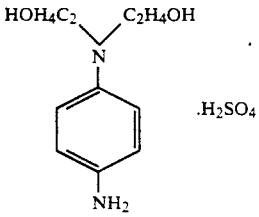
-continued
(A-8)
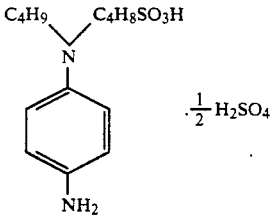
(A-9)
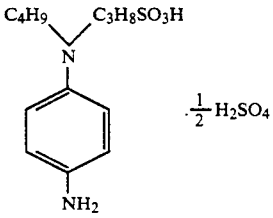
(A-10)
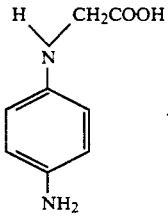
(A-11)
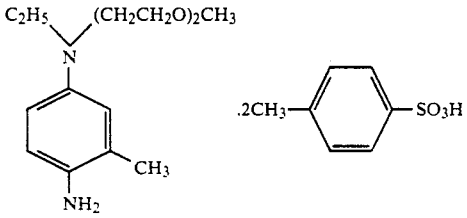
(A-12)
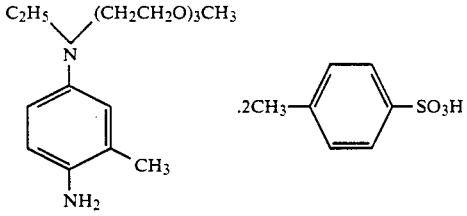
(A-13)
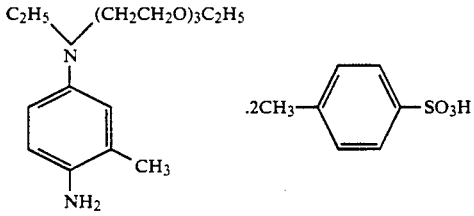
(A-14)
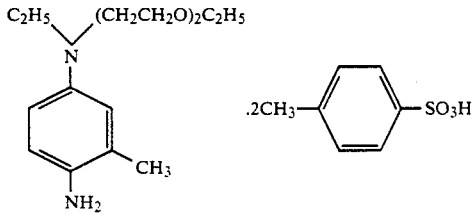

-continued

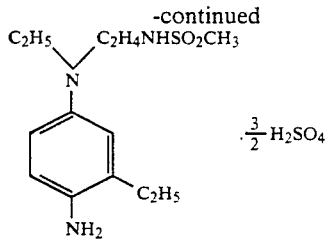

(A-15)

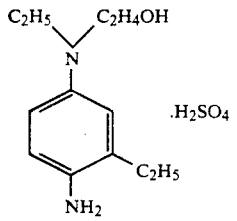

(A-16)

Among the color developing agents illustrated above. the preferred are (A-1), (A-2), (A-3), (A-4), (A-6), (A-7) and (A-15); the particularly preferred are (A-1) and (A-3).

These color developing agents are generally employed in the forms of hydrochlorides, sulfates or p-toluenesulfonates.

The addition amount of these p-phenylenediamine-type compounds is desirably more than $0.5\times10^{-2}$ mol/l, more desirably $1.0\times10^{-2}$ to $1.0\times10^{-1}$ mol/l and most desirably $1.5\times10^{-2}$ to $7.0\times10^{-2}$ mol/l of color developer.

The concentration of sulfite in the color developer is not more than $1.0\times10^{-2}$ mol. A low concentration not more than $5.0\times10^{-4}$ mol is particularly preferred, because it not only optimizes the effect of the invention but also heightens rapid processability.

In addition to the above, the color developer may contain the following components.

As alkali agents, there may be used, singly or in combination, sodium hydroxide, potassium hydroxide, silicates, potassium metaborate, sodium metaborate, trisodium phosphate, tripotassium phosphate and borax for keeping the pH stable, within the limits of maintaining a pH stabilizing effect without causing precipitation. Further, the color developer may contain various salts such as disodium hydrogenphosphate, dipotassium hydrogenphosphate, sodium bicarbonate, potassium bicarbonate and borates, for reasons of solution preparation or for the enrichment of ionic strength.

According to a specific requirement, organic or inorganic antifoggants may also be added.

Moreover, developing accelerators may be used when necessary. Examples of the developing accelerator include various pyridinium compounds and other cationic compounds, cationic dyes such as phenosafranine and neutral salts such as thallium nitrate, which are described in U.S. Pat. Nos. 2,648,604, 3,671,247 and Japanese Pat. Exam. Pub. No. 9503/1969; polyethylene glycols and derivatives thereof as well as nonionic compounds including polythioethers, which are described in U.S. Pat. Nos. 2,533,990, 2,531,832, 2,950,970, 2,577,127 and Japanese Pat. Exam. Pub. No. 9504/1969; phenethyl alcohol described in U.S. Pat. No. 2,304,925; and acetylene alcohol, methyl ethyl ketone, cyclohexanone, thioethers, pyridine, ammonia, hydrazine and amines.

Benzyl alcohol is not suitable to the present invention, and it is preferable to avoid use of poor-soluble organic solvents represented by phenethyl alcohol. The addition of these poor-soluble solvents causes tar to occur in a long use of a color developer, particularly in a continuously processing in a long term under a low replenishment. Once tar is formed, it sticks to a light-sensitive paper under processing, impairing fatally its value as a commodity. Moreover, the low water solubility of these poor-soluble organic solvents necessitates a stirring unit as an additional tool for the preparation of color developers. And, because of their low solubilities, even use of such a stirring unit is not sufficient for a proper developing acceleration. In addition, these poor-soluble organic solvents are high in biochemical oxygen demands; therefore, waste of them cannot be poured into drainage. And the waste has to be subjected to waste liquid treatment which needs a large expense and labor. Accordingly, it is preferable that the use of benzyl alcohol and other poor-soluble organic solvents be avoided or controlled to a small amount as much as possible.

Further, the color developer may use, if necessary, ethylene glycol, methyl cellosolve, methanol, acetone, dimethylformamide, β-cyclodextrin and compounds described in Japanese Pat. Exam. Pub. Nos. 33378/1972, 9509/1969 as organic solvents to enhance the solubility of a developing agent.

Auxiliary developers can be used together with developing agents. As such auxiliary developers, there are known N-methyl-p-aminophenol sulfate (Metol), phenidone, N,N'-diethyl-p-aminophenol hydrochloride and N,N,N',N'-tetramethyl-p-phenylenediamine hydrochloride. The addition amount thereof is generally 0.01 to 1.0 g/l.

In addition, various additives such as antistain agents, sludge inhibitors and multilayer effect accelerators may also be employed.

The above color developer components can be incorporated into a color developer by being dissolved separately in a prescribed amount of water and then added in sequence under stirring. In this case, low water-soluble components may be mixed with a foregoing organic solvent such as triethanolamine and then blended with other components. More generally, a color developer can be obtained by preparing, in small containers, concentrated aqueous solutions or solid mixtures each composed of plural components which coexist stably, and then adding these solutions or mixtures to water under stirring.

The color developer may be used in an arbitrary pH range, but a pH range of 9.5 to 13.0, particularly, 9.8 to 12.0 is preferred in view of rapid processability. The processing temperature in the color developer is generally higher than 30° C., preferably not lower than 33° C. and especially within the range from 35° to 65° C. The processing time is generally not longer than 90 seconds, preferably within the range of from 3 seconds to 60 seconds, and especially from 3 seconds to 45 seconds.

Since the effect of the invention is well exhibited in a low replenishment, the replenishing amount of the color developer is preferably 20 to 150 ml/m$^2$; a replenishing amount in a range from 30 to 120 ml/m$^2$ gives a much better antistain property.

In carrying out color development, there may be used the one-bath processing method as well as any of other processing methods including the spray method which sprays a processing solution on light-sensitive materials, the web method which makes a carrier impregnated with a processing solution contact with light-sensitive materials, a processing method using a viscous processing solution, and the slit development in which a small opening area is used.

It is preferable that the color developer of the invention contain a bistriazinylstilbene-type fluorescent brightener represented by the following formula.

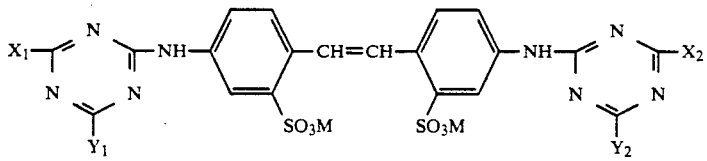

In the formula, $X_1$, $X_2$, $Y_1$ and $Y_2$ each represent a hydroxyl group, a halogen atom such as chlorine or bromine, an alkyl group, e.g., methyl, ethyl or aryl group, e.g., phenyl, methoxyphenyl, or

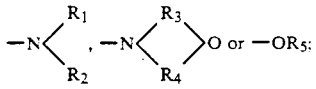

where $R_1$ and $R_2$ each represent a hydrogen atom, an alkyl group which may have a substituent or an aryl group which may have a substituent, $R_3$ and $R_4$ each represent an alkylene group which may have a substituent, $R_5$ represents a hydrogen atom, an alkyl group which may have a substituent or an aryl group which may have a substituent, and M represents a cation, e.g., sodium, potassium, ammonium.

The alkyl group represented by $R_1$, $R_2$ or $R_5$ is preferably one having 1 to 6 carbon atoms, and the alkylene group represented by $R_3$ or $R_4$ is preferably one having 1 to 2 carbon atoms.

The substituent for the alkyl group represented by $R_1$, $R_2$ or $R_5$, and for the alkylene group represented by $R_3$ or $R_4$, is preferably a hydroxy, sulfo, sulfoamino or carboxyamino group.

Typical examples of

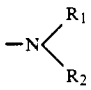

include amino group, alkylamino groups such as methylamino, ethylamino, propylamino, dimethylamino, cyclohexylamino, β-hydroxyethylamino, di(β-hydroxyethyl)amino, β-sulfoethylamino, N-(β-sulfoethyl)-N-methylamino and N-(β-hydroxyethyl)-N-methylamino) and arylamino groups such as anilino, sulfoanilino, chloroanilino, toluidino, carboxyanilino, sulfonaphthylamino, aminoanilino and anisidino. Typical examples of

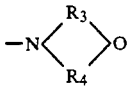

include morpholino groups; typical examples of $—OR_5$ include alkoxy groups e.g., methoxy, ethoxy, methoxyethoxy, and aryloxy groups e.g., phenoxy, p-sulfophenoxy.

Among fluorescent brighteners represented by the foregoing formula; the preferred are those in which $X_1$, $X_2$, $Y_1$ and $Y_2$ are all

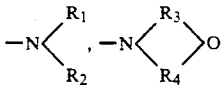

or $—OR_5$; and the particularly preferred are those in which one of $X_1$ and $Y_1$ is $—OR_5$ and the other is

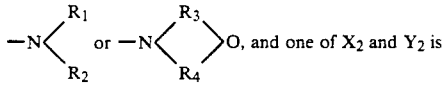

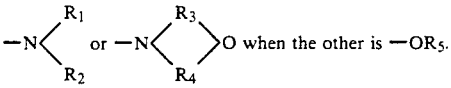

Typical examples are as follows.

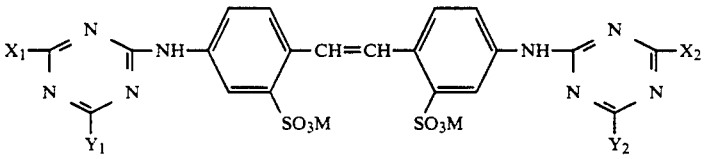

| No. | $X_1$ | $X_2$ | $Y_1$ | $Y_2$ |
|---|---|---|---|---|
| E-1 | 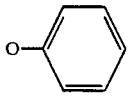 | | | $NHC_2H_4OH$ |
| E-2 | $NHC_2H_4OH$ | | | $NHC_2H_4OH$ |

-continued
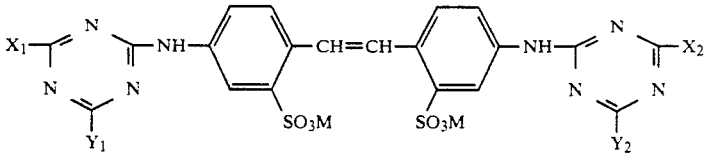
| No. | $X_1$ | $X_2$ | $Y_1$ | $Y_2$ |
|---|---|---|---|---|
| E-3 | 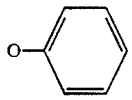 | | $N(C_2H_4OH)_2$ | |
| E-4 | $N(C_2H_4OH)_2$ | $NHC_2H_4SO_3Na$ | $OCH_3$ | |
| E-5 | $NHCH_2CHOH$ \| $CH_2OH$ | | $N(C_2H_4OH)_2$ | |
| E-6 | $N(C_2H_4OH)_2$ | | $N(C_2H_4OH)_2$ | |
| E-7 | 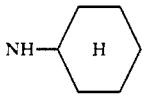 | | $NHC_2H_4OH$ | |
| E-8 | 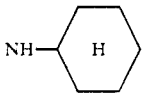 | | $N(C_2H_4OH)_2$ | |
| E-9 | OH | | 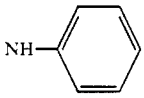 | |
| E-10 | $NH_2$ | | 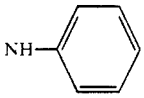 | |
| E-11 | $OCH_3$ | | 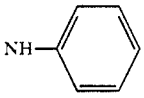 | |
| E-12 | $NHC_2H_4OH$ | | 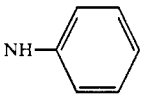 | |
| E-13 | $N(C_2H_4OH)_2$ | | 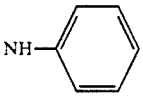 | |
| E-14 | $NHC_2H_4OH$ | | 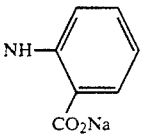 | |
| E-15 | 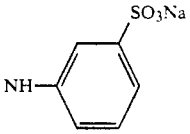 | | $N(C_2H_4OH)_2$ | |

-continued
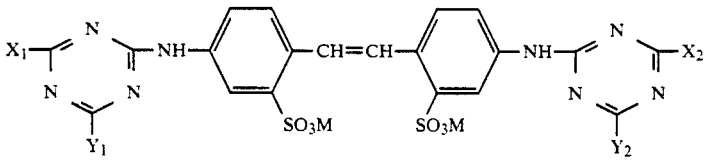
| No. | $X_1$ | $X_2$ | $Y_1$ | $Y_2$ |
|---|---|---|---|---|
| E-16 | 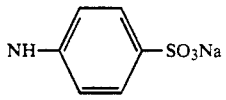 | | $N(C_2H_4OH)_2$ | |
| E-17 | 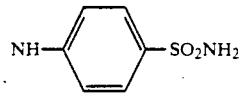 | | $N(C_2H_4OH)_2$ | |
| E-18 | 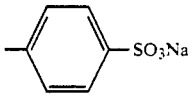 | | $N(C_2H_4OH)_2$ | |
| E-19 | $NHCH_2CH(CH_3)CH_2OH$ | | $OCH_3$ | |
| E-20 | $N(C_2H_4OH)_2$ | | 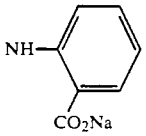 | |
| E-21 | $NHC_2H_4OH$ | | 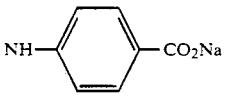 | |
| E-22 | 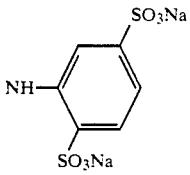 | | $NHC_2H_5$ | |
| E-23 | 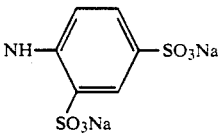 | | $NHCH_3$ | |
| E-24 | 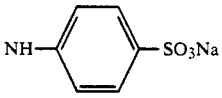 | | 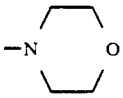 | |
| E-25 | $NHC_2H_4OH$ | | 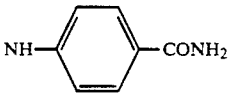 | |
| E-26 | $NHC_2H_4OH$ | | 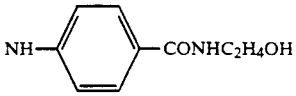 | |

-continued
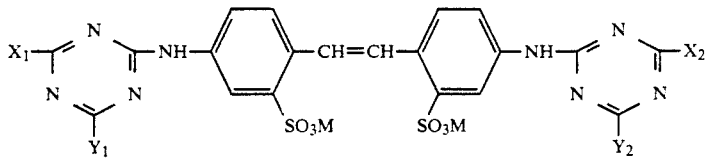
| No. | $X_1$ | $X_2$ | $Y_1$ | $Y_2$ |
|---|---|---|---|---|
| E-27 | $N(C_2H_4OH)_2$ | | 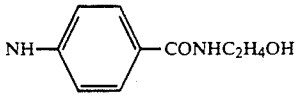 | |
| E-28 | $NHC_2H_4OH$ | | 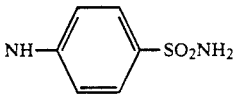 | |
| E-29 | $NHC_2H_4OH$ | | 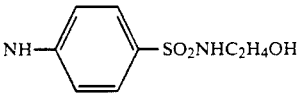 | |
| E-30 | $N(C_2H_4OH)_2$ | | 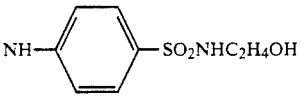 | |
| E-31 | 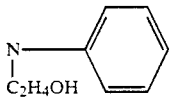 | | 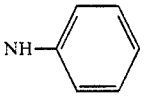 | |
| E-32 | 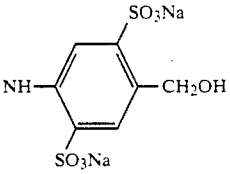 | | 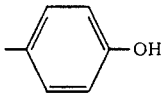 | |
| E-33 | 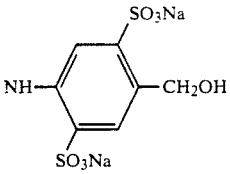 | | $NHC_2H_5$ | |
| E-34 | $OCH_3$ | | $NHCH_2CHOH$ \| $CH_3$ | |
| E-35 | 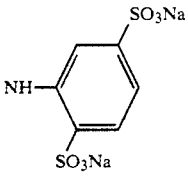 | | 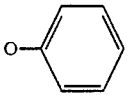 | |
| E-36 | 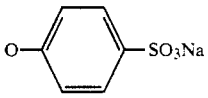 | | $N(C_2H_4OH)_2$ | |

-continued

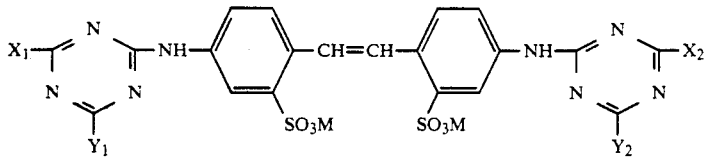

| No. | $X_1$ | $X_2$ | $Y_1$ | $Y_2$ |
|---|---|---|---|---|
| E-37 | $OCH_3$ | | 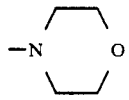 | |
| E-38 | $OCH_3$ | | $N(C_2H_4OH)_2$ | |
| E-39 | $OCH_3$ | | $N(C_2H_4OH)_2$ | $NHC_2H_4SO_3H$ |
| E-40 | $OCH_3$ | | $NHC_2H_4SO_3H$ | |
| E-41 | 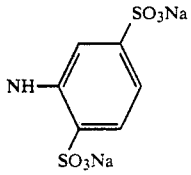 | | $N(C_2H_5)_2$ | |

In the above table, when only one substituent is given in the respective columns of $X_1$ & $X_2$ and $Y_1$ & $Y_2$ to an illustrated compound, it means that $X_1$ is equal to $X_2$ and $Y_1$ is equal to $Y_2$. In compounds E-1 through E-37, M equals Na; in compounds E-38 through E-41, M equals H.

The bistriazinylstilbene-type fluorescent brighteners favorably used in the invention can be synthesized by conventional methods described, for example, on page 8 of "Fluorescent Brighteners" edited by KASEIHIN KOGYO KAI (August, 1976).

The bistriazinylstilbene-type fluorescent brighteners are used in amounts of 0.2 to 6 grams, preferably 0.4 to 3 grams per liter of the color developer.

In light-sensitive materials to be processed by the method of the invention, silver halide grains may be any of regular crystals, twin crystals and others, and may have any [1.0.0] face to [1.1.1] face ratio. Further, the crystal structure of these silver halide grains may be uniform from inner portion to outer portion, or of layered structure (core shell type) different in composition from inner portion to outer portion. Moreover, these silver halide grains may be ones in which latent images are mainly formed on the surface, or ones in which latent images are mainly formed inside of the grains. In addition, tabular silver halide grains described in Japanese Pat. O.P.I. Pub. No. 113934/1983 and Japanese Pat. Appl. No. 170070/1984, may also be used.

The foregoing silver halide grains may be prepared by any of the acid method, neutral method and ammonia method.

Further, these grains may be prepared by two steps. For example, seed grains are prepared by the acid method, and then the seed grains are grown to a prescribed size by the ammonia method which provides a faster growth rate. In growing silver halide grains, it is preferable that while controlling the pH and pAg in the reaction vessel, silver ions and halide ions be added and mixed simultaneously in proportion to the growth rate of silver halide grains as described, for example, in Japanese Pat. O.P.I. Pub. No. 48521/1979.

The foregoing silver halide grains are advantageously prepared in the procedure described above, and a composition containing said silver halide grains is referred to as a silver halide emulsion in this specification.

The grain size of silver halide is in a range from 0.1 to 1.2 μm; preferably, in a range from 0.2 to 1.0 μm in order to heighten the effect of the invention.

Silver halide emulsion layers containing silver halide grains used in the method of invention contain color couplers. These color couplers form non-diffusible dyes by reaction with an oxidation product of a color developing agent. Color couplers are advantageously coupled in a non-diffusible form in light-sensitive layers or closely adjoining them.

Thus, a red-sensitive layer can contain, for example, a non-diffusible color coupler to form cyan color images, which are generally phenol-type or α-naphthol-type couplers. A green-sensitive layer can contain, for example, a non-diffusible color coupler to from magenta color images, which are generally a 5-pyrazolone-type color couplers or pyrazolotriazole-type color couplers. A blue-sensitive layer can contain, for example, a non-diffusible color coupler to form yellow color images, which are generally color couplers containing an open chain ketomethylene group. These couplers may be 6-, 4- or 2-equivalent ones. In the invention, 2-equivalent couplers are particularly preferred.

Suitable couplers are disclosed, for example, in the following publications: Agfa's research paper (Mitteilungen aus den Forschungslaboratorien der Agfa), Leverkusen/Munchen, Vol. III (1961), p. 111, Farbkuppler by W. Pelz; The Chemistry of Synthetic Dyes by K. Venkataraman, Vol. 4, pp. 341–387; The Theory of the Photographic Process 4th Edition, pp.353–362, published by Academic Press; and Research Disclosure No. 17643, Sec. VII.

From the viewpoint of the invention's objective effect, particularly preferred couplers used in light-sensitive materials of the invention are magenta couplers represented by Formula [M-I] shown on page 26 of the specification of Japanese Pat. O.P.I. Pub. No. 106655/1988, typical examples thereof are those illustrated on pages 29-34 of the same specification bearing Nos. 1 through 77; cyan couplers represented by Formula [C-I] or [C-II] shown on 34 page of the same specification, typical examples thereof are those illustrated on pages 37–42 of the same bearing Nos. (C'-1) through (C'-82) and (C''-1) through (C''-36); and high-speed yellow couplers described on page 20 of the same specification, typical examples thereof illustrated on pages 21–26 of the same bearing Nos. (Y'-1) through (Y'-39).

In the invention, one preferable embodiment is to use a nitrogen-containing heterocyclic mercapto compound in combination with the high silver chloride light-sensitive material of the invention. This not only brings out the objective effect of the invention, but also minimizes an adverse effect on photographic properties when a bleach-fixer gets mixed in a color developer.

Typical examples of the nitrogen-containing heterocyclic mercapto compound include ones illustrated with Nos. (I'-1) through (I'-87) on pages 42–45 of the specification of Japanese Pat. O.P.I. Pub. No. 106655/1988.

Emulsions may be chemically sensitized. Preferred chemical sensitizers are sulfur-containing compounds such as arylthioisocyanates, arylthioureas and thiosulfates.

Reducing agents are also useful as chemical sensitizers. Examples thereof include silver compounds described in Belgian Pat. Nos. 493,464 and 568,687; and polyamines such as diethylenetriamine and aminomethylsulfinic acid derivatives, which are described in Belgian Pat. Nos. 547,323. Precious metals such as gold, platinum, palladium, iridium, ruthenium and rhodium as well as precious metal compounds can also be used as sensitizers. This chemical sensitization is described in R. Koslovsky's paper contained in Zeitschrift fur Wissenschaftliche Photographie 46, pp. 65–72(1951). Description on the matter can also be seen in Research Disclosure No. 17643, Sec. III.

The emulsion can be spectrally sensitized by conventional methods. Such spectral sensitization can be carried out using, singly or in combination, cyanines, merocyanines, complex cyanines, holopolar cyamine or hemicyanines. Details of spectral sensitization are described in The Cyanine Dyes and related Compounds by F. M.Hamer, (1964); Ullmanns Enzyklpadieder technischen Chemie, 4th Edition, Vol. 18, p.431; and Research Disclosure No. 17643, Sec. IV.

The emulsion may contain conventional antifoggants and stabilizers. Azaindenes are useful as stabilizers. And tetra- and penta-azaindenes are preferable; among them, those substituted with a hydroxyl group or amino group are especially preferable. This type of compounds can be seen in Birr's paper contained in Zeitschrift fur Wissenschaftliche Photographie 47, pp. 2–58(1952) and Research Disclosure No. 17643, Sec. IV.

Components of the light-sensitive material can be incorporated by conventional methods known in the art, for example, by U.S. Pat. Nos. 2,322,027, 2,533,514, 3,689,271, 3,764,336 and 3,765,897.

Some components of the light-sensitive material—couplers and UV absorbents, for example—can also be incorporated in the form of charged latex as described in German Offenlegungshrift No. 2,541,274 and European Pat. Appl. No. 14,921.

Some components can be fixed in the light-sensitive material in the form of polymer as described, for example, in German Offenlegungshrift No. 2,044,992 and U.S. Pat. Nos. 3,370,952 and 4,080,211.

In the silver halide color photographic light-sensitive material to be used in the invention, the total amount of coated silver is 0.2 to 1.0 g/m$^2$, preferably 0.3 to 0.8 g/m$^2$ of the light-sensitive material, in order to enhance the effect of the invention.

As the support for the light-sensitive material, conventional supports can be employed. Examples thereof are cellulose ester supports including cellulose acetate and polyester supports. Paper supports are also useful, these may be coated with polyolefines, particularly polyethylene or polypropylene. Description of the matter is contained in Research Disclosure No. 17643, Secs. V and VI.

The present invention is suitably applicable for light-sensitive materials which contain in themselves couplers and are processed by the so-called coupler-in-emulsion type color developing method, and can be applied to any of various light-sensitive materials such as color paper, color negative film, color positive film, color reversal film for slides, color reversal film for movies, color reversal film for TV, and reversal color paper.

EXAMPLES

Example 1

A multilayered silver halide color photographic light-sensitive material was prepared by forming layers of the following constitutions, on the titanium-dioxide-containing side of a paper support laminated with polyethylene containing titanium dioxide on one side and with polyethylene on the other side.

Coating solutions used were prepared as follows:

Coating solution for 1st layer

There were dissolved 26.7 g of yellow coupler (Y-1), 10.0 g of dye image stabilizer (ST-1), 6.67 g of (ST-2) and 0.67 g of additive (HQ-1) in 0.67 g of high boiling organic solvent (DNP) and 60 ml of ethyl acetate. Then, the solution was dispersed in 220 ml of 10% aqueous gelatin containing 7 ml of 20% surfactant (SU-1) with a supersonic homogenizer to obtain a yellow coupler dispersion.

The dispersion was then mixed with a blue-sensitive silver halide emulsion, containing 10 g of silver, prepared under conditions described later. Thus, a coating solution for the 1st layer was prepared.

Further, coating solutions for the 2nd to 7th layers were prepared likewise.

| Layer | Constitution | Addition amount (g/m$^2$) |
|---|---|---|
| 7th layer (protective layer) | gelatin | 1.00 |
| 6th layer (UV absorbing layer) | gelatin | 0.40 |
| | UV absorbent UV-1 | 0.10 |
| | UV absorbent UV-2 | 0.04 |
| | UV absorbent UV-3 | 0.16 |
| | antistain agent HQ-1 | 0.01 |
| | DNP | 0.20 |
| | PVP | 0.03 |
| | anti-irradiation dye AI-2 | 0.02 |
| 5th layer (red-sensitive layer) | gelatin | 1.30 |
| | red-sensitive silver chlorobromide emulsion Em-R | 0.21 |
| | cyan coupler C-1 | 0.42 |
| | cyan coupler C-2 | 0.25 |
| | dye image stabilizer ST-1 | 0.20 |
| | antistain agent HQ-1 | 0.01 |
| | HBS-1 | 0.20 |

-continued

| Layer | Constitution | Addition amount ($g/m^2$) |
|---|---|---|
| | DOP | 0.20 |
| 4th layer (UV absorbing layer) | gelatin | 0.94 |
| | UV absorbent UV-1 | 0.28 |
| | UV absorbent UV-2 | 0.09 |
| | UV absorbent UV-3 | 0.38 |
| | antistain agent HQ-1 | 0.03 |
| | DNP | 0.40 |
| 3rd layer (green-sensitive layer) | gelatin | 1.40 |
| | green-sensitive silver chlorobromide emulsion Em-G | 0.17 |
| | magenta coupler M-1 | 0.35 |
| | dye image stabilizer ST-3 | 0.15 |
| | dye image stabilizer ST-4 | 0.15 |
| | dye image stabilizer ST-5 | 0.15 |
| | DNP | 0.20 |
| | anti-irradiation dye AI-1 | 0.02 |

-continued

| Layer | Constitution | Addition amount ($g/m^2$) |
|---|---|---|
| 2nd layer (intermediate layer) | gelatin | 1.20 |
| | antistain agent HQ-2 | 0.12 |
| | DIDP | 0.15 |
| 1st layer (blue-sensitive layer) | gelatin | 1.20 |
| | blue-sensitive silver chlorobromide emulsion Em-B | 0.26 |
| | yellow coupler Y-1 | 0.80 |
| | dye image stabilizer ST-1 | 0.30 |
| | dye image stabilizer ST-2 | 0.20 |
| | antistain agent HQ-1 | 0.02 |
| | anti-irradiation dye AI-3 | 0.01 |
| | DNP | 0.20 |
| Support | polyethylene laminated paper | |

Notes: Addition amounts of silver halide emulsions are given in amounts of silver present.

Y-1

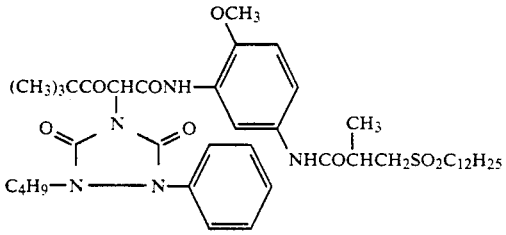

M-1

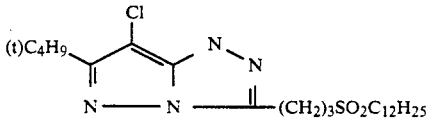

C-1

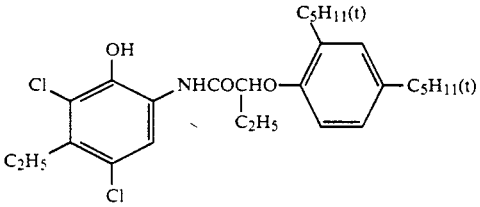

C-2

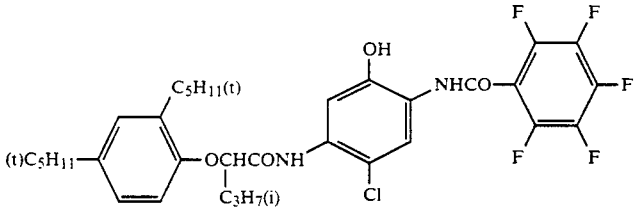

ST-1

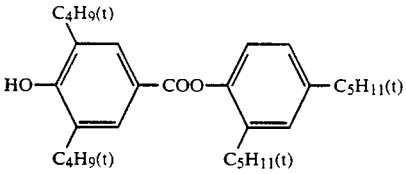

ST-2

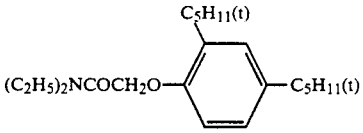

ST-3

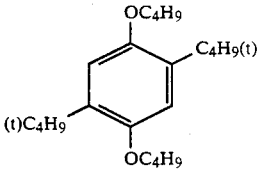

ST-4

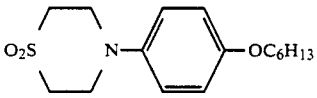

ST-5

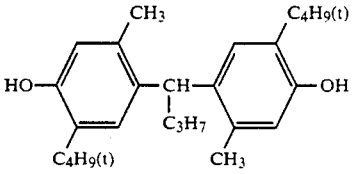

UV-1

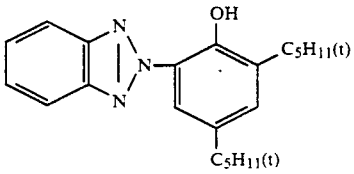

-continued

UV-2

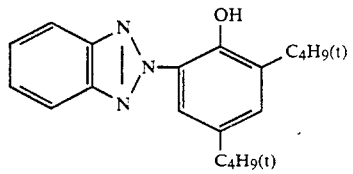

UV-3

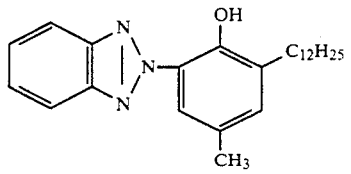

DOP Diocytl phthalate
DIDP Diisodecyl phthalate

DNP Dinonyl phthalate
PVP Polyvinyl pyrrolidone

HBS-1

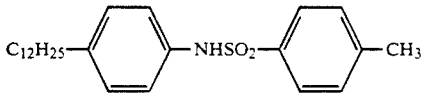

HQ-1

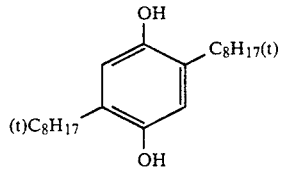

HQ-2

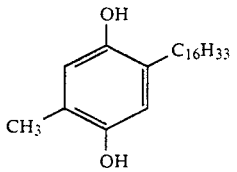

SU-1

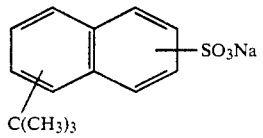

AI-1

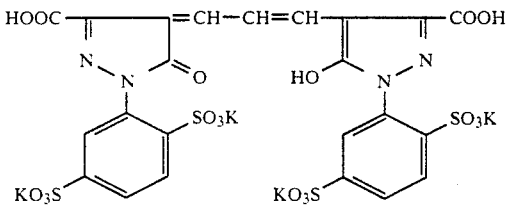

AI-2

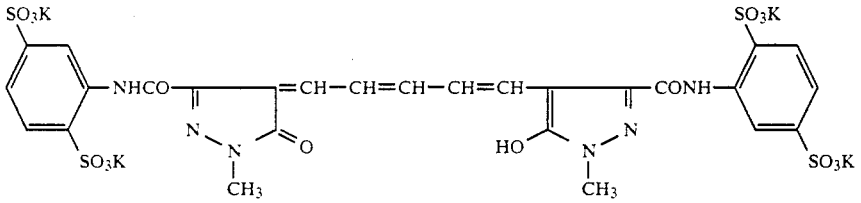

AI-3

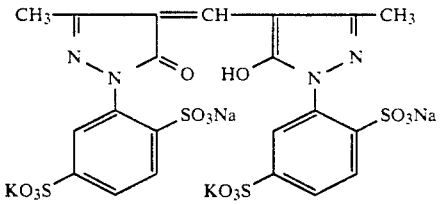

As the hardener, the following H-1 was used.

H-1

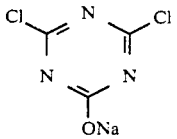

Preparation of blue-sensitive silver halide emulsion

The following solutions A and B were simultaneously added to 1000 ml of a 2% aqueous gelatin maintained at 40° C. over a period of 30 minutes, while controlling the pAg at 6.5 and the pH at 3.0. Then, the following solutions° C. and D were simultaneously added thereto over a period of 180 minutes, while controlling the pAg at 7.3 and the pH at 5.5.

During the addition, the pAg was controlled by the method described in Japanese Pat. O.P.I. Pub. No. 45437/1983, the pH was controlled with sulfuric acid or an aqueous solution of sodium hydroxide.

| | |
|---|---|
| Solution A | |
| Sodium chloride | 3.42 g |
| Potassium bromide | 0.03 g |
| Water to make | 200 ml |
| Solution B | |
| Silver nitrate | 10 g |
| Water to make | 200 ml |

-continued

| | |
|---|---|
| Solution C | |
| Sodium chloride | 102.7 g |
| Potassium bromide | 1.0 g |
| Water to make | 600 ml |
| Solution D | |
| Silver nitrate | 300 g |
| Water to make | 600 ml |

After the addition, the reaction product was desalted using a 5% aqueous solution of Demol N (product of Kao Atlas) and a 20% aqueous solution of magnesium sulfate, and then mixed with an aqueous gelatin. Monodispersed cubic emulsion EMP-1 thus obtained had an average grain size of 0.85 μm, a distribution variation coefficient ($\sigma/\bar{r}$) of 0.07 and a silver chloride content of 99.5 mol %. In the distribution variation coefficient, $\sigma$ is the standard deviation of grain size distribution and $\bar{r}$ is the average grain size Next, EPM-1 was subjected to chemical ripening at 50° C. for 90 minutes using the following compounds, to obtain a blue-sensitive silver halide emulsion, Em-B.

| | |
|---|---|
| Sodium thiosulfate | 0.8 mg/mol AgX |
| Chloroauric acid | 0.5 mg/mol AgX |
| Stabilizer SB-5 | $6 \times 10^{-4}$ mol/mol AgX |
| Sensitizing dye D-1 | $4.3 \times 10^{-4}$ mol/mol AgX |
| Sensitizing dye D-4 | $0.7 \times 10^{-4}$ mol/mol AgX |

solutions A and B as well as that of solutions C and D were changed.

EMP-2 was chemically sensitized for 120 minutes at 55° C. using the following compounds to obtain a green-sensitive silver halide emulsion, Em-G.

| | |
|---|---|
| Sodium thiosulfate | 1.5 mg/mol AgX |
| Chloroauric acid | 1.0 mg/mol AgX |
| Stabilizer SB-5 | $6 \times 10^{-4}$ mol/mol AgX |
| Sensitizing dye D-2 | $4 \times 10^{-4}$ mol/mol AgX |

Preparation of red-sensitive silver halide emulsion

There was prepared a monodispersed cubic emulsion, EMP-3, having an average grain size of 0.50 μm, a distribution variation coefficient ($\sigma/r$) of 0.08 and a silver chloride content of 99.5 mol %, in the same procedure as in EMP-1, except that the addition time of solutions A and B as well as that of solutions C and D were changed.

Then, EMP-3 was chemically sensitized for 90 minutes at 60° C. using the following compounds to obtain a red-sensitive silver halide emulsion, Em-R.

| | |
|---|---|
| Sodium thiosulfate | 1.8 mg/mol AgX |
| Chloroauric acid | 2.0 mg/mol AgX |
| Stabilizer SB-5 | $6 \times 10^{-4}$ mol/mol AgX |
| Sensitizing dye D-3 | $1 \times 10^{-4}$ mol/mol AgX |

D-1

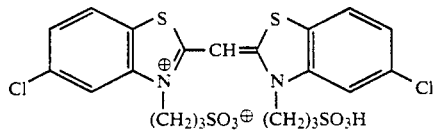

D-2

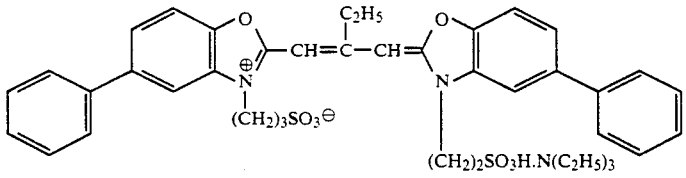

D-3

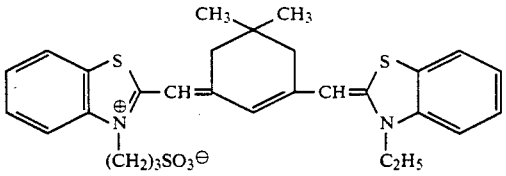

D-4

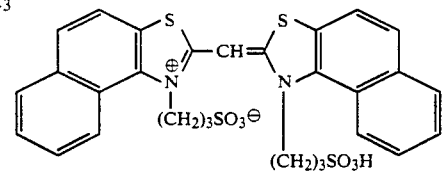

SB-5

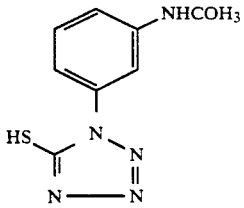

Preparation of green-sensitive silver halide emulsion

There was prepared a monodispersed cubic emulsion, EMP-2, having an average grain size of 0.43 μm, a distribution variation coefficient ($\sigma/r$) of 0.08 and a silver chloride content of 99.5 mol %, in the same procedure as in EMP-1, except that the addition time of The sample was exposed according to a conventional method, and then, processed using the following conditions and processing solutions.

| Processing | Processing conditions Temp. (°C.) | Time (sec) | Replenishing amount (ml) | Tank capacity (l) |
|---|---|---|---|---|
| (1) Color developing | 39.0 ± 0.3 | 45 | 40 | 5 |
| (2) Bleach-fixing | 35.0 ± 0.5 | 45 | 51 | 5 |
| (3) Stabilizing (3-tank cascade) | 30–34 | 90 | 248 | 5 × 3 (tanks) |
| (4) Drying | 60–80 | 30 | — | — |

The replenishing amount is that per square meter of light-sensitive material processed. In the stabilizing process, replenishment was made countercurrently in a direction from the third tank to the first tank.

| Color developer tank solution | |
|---|---|
| Color developer replenishing solution (described below) | 500 ml |
| Potassium chloride | 9.0 g |

Water is added to make 1 liter, and the pH is adjusted to 10.10 with sulfuric acid.

| Color developer replenishing solution | |
|---|---|
| Diethylene glycol | 30.0 g |
| N,N-Diethylhydroxylamine | 10.0 g |
| Diethylenetriaminepentacetic acid | 7.5 g |
| Potassium sulfite | 0.3 g |
| Fluorescent brightening agent, Tinopal SFP (Product of Ciba Geigy) | 20.0 g |
| 3-methyl-4-amino-N-ethyl-N-(62 - methanesulfonamidoethyl-aniline sulfate) | 12.0 g |
| Potassium carbonate | 30.0 g |
| Potassium phosphate | 20.0 g |

Water is added to make 1 liter, and then the pH is adjusted to 12.00 with sodium hydroxide or sulfuric acid.

| Bleach-fixer tank solution | |
|---|---|
| Ammonium ferric ethylenediaminetetracetate dihydrate | 0.15 mol |
| Ethylenediaminetetracetic acid | 0.01 mol |
| Ammonium thiosulfate | 0.7 mol |
| Sodium thiosulfate | 0.3 mol |
| Sodium sulfite | 0.1 mol |
| Ammonium bromide | 0.1 mol |

Water is added to make 1 liter, and the pH is adjusted to 5.5 with an aqueous ammonia or acetic acid.

| Bleach-fixer replenishing solution | |
|---|---|
| Ammonium ferric ethylenediaminetetracetate dihydrate | 0.3 mol |
| Ethylenediaminetetracetic acid | 0.02 mol |
| Ammonium thiosulfate | 1.4 mol |
| Sodium thiosulfate | 0.6 mol |
| Sodium sulfite | 0.2 mol |
| Ammonium bromide | 0.3 mol |

Water is added to make 1 liter, and the pH is adjusted to 5.5 with an aqueous ammonia or acetic acid.

| Stabilizer tank solution and replenishing solution | |
|---|---|
| o-Phenylphenol | 0.15 g |
| Zinc sulfate heptahydrate | 0.2 g |

-continued

| Stabilizer tank solution and replenishing solution | |
|---|---|
| Bismuth chloride | 0.5 g |
| Ammonium sulfite (40% solution) | 5.0 ml |
| 1-Hydroxyethylidene-1,1-diphosphonic acid | 3.8 g |
| (60% solution) | 3.8 g |
| Ethylenediaminetetracetic acid | 2.0 g |
| Fluorescent brightening agent | 2.0 g |
| Tinopal SFP | |

The pH is adjusted to 7.8 with an aqueous ammonia or a 50% sulfuric acid and water is added to make 1 liter.

After filling the tanks of an automatic processor with the foregoing color developer tank solution, bleach-fixer tank solution and stabilizer tank solution respectively, a running treatment was carried out by replenishing the above color developer replenishing solution, bleach-fixer replenishing solution and stabilizer replenishing solution through a constant flow pump while processing the foregoing color paper sample.

This processing was continuously run for 30 days, while processing 3 $m^2$ of the color paper every day.

After termination of the running of processing, the processed paper were examined for unevenness in magenta, amount of residual silver and recoloring failure.

The unevenness in magenta was visually checked; the amount of residual silver was determined with a fluorescent X-ray spectrometer.

In determining the recoloring failure, the density was measured at a Dmax portion of the sample with red light by Konica Model PDA-65 densitometer, and the sample was re-oxidized for 3 minutes in a 30 g ±ammonium ferric ethylenediaminetetracetate dihydrate solution adjusted at pH 6.0. Subsequently, the density at the same portion was measured again in the same manner as above. The degree of recoloring failure is given by the value of (measured value after re-oxidizing treatment-)—(measured value before re-oxidizing treatment), and the larger the value is, the larger the degree of recoloring failure is.

The evaluation of corrosiveness was made by observing the degree of rusting after repeating, 20 times a day for 30 days, a procedure of dropping 1 ml of the bleach-fixer on a SUS304 plate and allowing it to air dry.

Surface area of the bleach-fixer opened to air in the processing tank was controlled by the size of a floating lid floated on the liquid surface of the bleach-fixer.

The results are shown in Table 1.

The unevenness in magenta and corrosiveness or generation of rust were rated by the following standards.

A: not observed at all.

B: slightly generated. But concerning rust, leaving the rust as it is will necessitate replacement of parts.

C: obviously observed, and not suitable for practical use.

Increase in the number of Cs means occurrence in heavier degrees.

A residual silver amount of 0.5 mg/100 $cm^2$ is regarded to be the largest allowable value in appreciating photographs; an amount of residual silver larger than that causes a fluctuation in gradation and impurity in color, and thereby lowers the quality of images inevitably.

The same may be said of the recoloring failure, and its value must be less than 0.05. For both the recoloring failure and amount of residual silver, decrease in the value means a better quality in a finished photographic image.

The effect of the invention will be obviously understood from the results shown in Table 1.

TABLE 1

| Experiemnt No. | pH | $NH_4Br$* | Opening area | Unevenness in magenta image | Residual silver amount | Recoloring failure | Corrosiveness | Remarks |
|---|---|---|---|---|---|---|---|---|
| 1-1 | 5.0 | 0.15 | 35 | A | 0.1 | 0.20 | CC | Comparison |
| 1-2 | 6.0 | 0.15 | 35 | A | 0.1 | 0.05 | CC | Comparison |
| 1-3 | 6.3 | 0.15 | 35 | A | 0.1 | 0.05 | CC | Comparison |
| 1-4 | 6.5 | 0.15 | 35 | A | 0.1 | 0.01 | A | Invention |
| 1-5 | 7.0 | 0.15 | 35 | A | 0.1 | 0.01 | A | Invention |
| 1-6 | 7.5 | 0.15 | 35 | A | 0.1 | 0.01 | A | Invention |
| 1-7 | 7.7 | 0.15 | 35 | A | 0.3 | 0.01 | A | Invention |
| 1-8 | 8.0 | 0.15 | 35 | A | 0.3 | 0.01 | A | Invention |
| 1-9 | 8.2 | 0.15 | 35 | A | 0.5 | 0.01 | A | Invention |
| 1-10 | 8.5 | 0.15 | 35 | A | 0.5 | 0.01 | A | Invention |
| 1-11 | 8.7 | 0.15 | 35 | C | 1.2 | 0.01 | A | Comparison |
| 1-12 | 9.0 | 0.15 | 35 | C | 1.5 | 0.01 | A | Comparison |
| 1-13 | 7.0 | 0 | 35 | C | 1.0 | 0.01 | A | Comparison |
| 1-14 | 7.0 | 0.008 | 35 | C | 0.9 | 0.01 | A | Comparison |
| 1-15 | 7.0 | 0.01 | 35 | B | 0.5 | 0.01 | A | Invention |
| 1-16 | 7.0 | 0.03 | 35 | B | 0.5 | 0.01 | A | Invention |
| 1-17 | 7.0 | 0.05 | 35 | A | 0.3 | 0.01 | A | Invention |
| 1-18 | 7.0 | 0.07 | 35 | A | 0.3 | 0.01 | A | Invention |
| 1-19 | 7.0 | 0.08 | 35 | A | 0.1 | 0.01 | A | Invention |
| 1-20 | 7.0 | 0.30 | 35 | A | 0.1 | 0.01 | A | Invention |
| 1-21 | 7.0 | 0.40 | 35 | A | 0.3 | 0.01 | A | Invention |
| 1-22 | 7.0 | 0.50 | 35 | A | 0.3 | 0.01 | A | Invention |
| 1-23 | 7.0 | 0.80 | 35 | A | 0.5 | 0.01 | A | Invention |
| 1-24 | 7.0 | 1.00 | 35 | A | 0.5 | 0.01 | A | Invention |
| 1-25 | 7.0 | 1.2 | 35 | A | 1.0 | 0.01 | C | Comparison |
| 1-26 | 7.0 | 1.5 | 35 | A | 1.1 | 0.01 | C | Comparison |
| 1-27 | 7.0 | 0.15 | 1 | A | 0.5 | 0.15 | A | Comparison |
| 1-28 | 7.0 | 0.15 | 5 | A | 0.5 | 0.12 | A | Comparison |
| 1-29 | 7.0 | 0.15 | 8 | A | 0.1 | 0.05 | A | Invention |
| 1-30 | 7.0 | 0.15 | 11 | A | 0.1 | 0.05 | A | Invention |
| 1-31 | 7.0 | 0.15 | 13 | A | 0.1 | 0.03 | A | Invention |
| 1-32 | 7.0 | 0.15 | 23 | A | 0.1 | 0.03 | A | Invention |
| 1-33 | 7.0 | 0.15 | 25 | A | 0.1 | 0.01 | A | Invention |
| 1-34 | 7.0 | 0.15 | 35 | A | 0.1 | 0.01 | A | Invention |
| 1-35 | 7.0 | 0.15 | 50 | A | 0.1 | 0.01 | A | Invention |
| 1-36 | 7.0 | 0.15 | 55 | A | 0.3 | 0.01 | A | Invention |
| 1-37 | 7.0 | 0.15 | 80 | A | 0.3 | 0.01 | A | Invention |
| 1-38 | 7.0 | 0.15 | 85 | A | 0.5 | 0.03 | A | Invention |
| 1-39 | 7.0 | 0.15 | 100 | A | 0.5 | 0.03 | A | Invention |
| 1-40 | 7.0 | 0.15 | 120 | A | 1.0 | 0.05 | B | Comparison |
| 1-41 | 7.0 | 0.15 | 150 | A | 1.0 | 0.05 | B | Comparison |

*Units in the table are: $NH_4Br$: mol/l, opening area: $cm^2/l$, residual silver amount: $mg/100\ cm^2$.

Example 2

The procedures in experiment Nos. 1 through 5 of Example 1 were repeated, except that the ferric ethylenediamine-tetracetate was replaced by compounds shown in Table 2, which are the ferric aminopolycarboxylates.

The results are shown in Table 2.

It is seen in Table 2 that the effect of the invention to control unevenness in magenta, rusting and residual silver amount is well exhibited even when the bleaching agent is changed to other bleaching agents of the invention, and that the effect of the invention is well brought out by the use of ferric diethylenetriaminepentacetate, ferric cyclohexanediaminetetracetate and ferric glycoletherdiaminetetracetate, similarly to the use of ferric ethylenediaminetetracetate.

TABLE 2

| Experiment No. | Ferric aminopolycarboxylate | Unevenness magenta in image | Rust | Residual silver amount |
|---|---|---|---|---|
| 3-1 | Ferric diethylene-triaminepentacetate | A | A | 0.1 |
| 3-2 | Ferric cyclohexane-diaminetetracetate | A | A | 0.1 |
| 3-3 | Ferric glycol-etherdiamine-tetracetate | A | A | 0.1 |
| 3-4 | Ferric nitrilotriacetate | B | A | 0.1 |
| 3-5 | Ferric iminodiacetate | B | A | 0.3 |
| 3-6 | Ferric phenylene-diaminetetracetate | B | A | 0.3 |
| 1-12 | Ferric ethylene-diaminetetracetate | A | A | 0.1 |

Example 3

Running of processing were carried out in a similar manner as in Example 1, with replenishment of the bleach-fixer varied as shown in Table 3 and a daily processing amount light-sensitive material of 1 $m^2$. After completion of the experiment, generation of tar was checked on the liquid surface of the bleach-fixer, walls of the bleach-fixer tank and racks.

With respect to the corrosiveness, a 10-cm long SUS304 plate was fixed in the bleach-fixer tank so as to immerse it at a depth of 5 cm before the running experiment, after completion of the running experiment, it was taken out and checked for rust. A, B and C in the table have the same meanings as in Example 1.

The results are shown in Table 3.

It is apparent from Table 3 that the invention is effective in preventing tar formation and in inhibiting rust, and that such effect is particularly noticeable when the replenishment of bleach-fixer is not more than 100 ml/m$^2$ especially so when it is not more than 60 ml/m$^2$.

TABLE 3

| Experiment No. | pH | $NH_4Br$ | Opening area | Replenishing amount | Tar | Corrosiveness | Remarks |
|---|---|---|---|---|---|---|---|
| 4-1 | 7.0 | 0.3 | 40 | 250 | A | A | Invention |
| 4-2 | 7.0 | 0.3 | 40 | 150 | A | A | Invention |
| 4-3 | 7.0 | 0.3 | 40 | 100 | A | A | Invention |
| 4-4 | 7.0 | 0.3 | 40 | 80 | A | A | Invention |
| 4-5 | 7.0 | 0.3 | 40 | 60 | A | A | Invention |
| 4-6 | 7.0 | 0.3 | 40 | 40 | A | A | Invention |
| 4-7 | 7.0 | 0.3 | 120 | 250 | C | CC | Comparison |
| 4-8 | 7.0 | 0.3 | 120 | 150 | C | CC | Comparison |
| 4-9 | 7.0 | 0.3 | 120 | 100 | CC | C | Comparison |
| 4-10 | 7.0 | 0.3 | 120 | 80 | CC | C | Comparison |
| 4-11 | 7.0 | 0.3 | 120 | 60 | CCC | B | Comparison |
| 4-12 | 7.0 | 0.3 | 120 | 40 | CCC | B | Comparison |

Units in the table are same as those in Table 1.

Example 4

Running experiments were performed in a similar manner as in Example 1, while varying the concentration of sulfite in the bleach-fixer as shown in Table 4 by adjusting the amount of sodium sulfite contained in the bleach-fixer replenishing solution.

After completion of the experiments, the liquid surface, walls of the bleach-fixer tank and racks were checked if there were any tar. And the corrosiveness was evaluated in the same manner as in Example 3.

The results are shown in Table 4, where ratings A, B and C for the tar generation indicate the following:

A: not generated at all

B: slightly generated

C: obviously generated, but tar generation is limited to the liquid surface, and the tank walls, racks and paper being processed are not stained with tar.

D: tar sticks to the tank walls and racks, causing stains on the paper under processing; the more the number of Ds is, the heavier the sticking is.

Ratings A, B and C for the corrosiveness are the same as those in Example 1.

It is understood from Table 4 that a sulfite concentration of 0.03 to 0.30 mol/l causes less rust, tar and recoloring failure, and that this effect is more noticeable at a concentration of 0.06 to 0.20 mol/l.

TABLE 4

| Experiment No. | pH | $NH_4Br$ mol/l | Opening area cm$^2$/l | Sulfite conc. mol/l | Tar | Defective recoloring | Corrosivenss | Remarks |
|---|---|---|---|---|---|---|---|---|
| 3-1 | 7.0 | 0.2 | 40 | 0.1 | C | 0.01 | B | Invention |
| 3-2 | 7.0 | 0.2 | 40 | 0.02 | C | 0.01 | B | Invention |
| 3-3 | 7.0 | 0.2 | 40 | 0.03 | B | 0.01 | B | Invention |
| 3-4 | 7.0 | 0.2 | 40 | 0.05 | B | 0.01 | B | Invention |
| 3-5 | 7.0 | 0.2 | 40 | 0.06 | A | 0.01 | B | Invention |
| 3-6 | 7.0 | 0.2 | 40 | 0.10 | A | 0.01 | B | Invention |
| 3-7 | 7.0 | 0.2 | 40 | 0.20 | A | 0.01 | B | Invention |
| 3-8 | 7.0 | 0.2 | 40 | 0.25 | A | 0.03 | B | Invention |
| 3-9 | 7.0 | 0.2 | 40 | 0.30 | A | 0.03 | B | Invention |
| 3-10 | 7.0 | 0.2 | 40 | 0.35 | A | 0.05 | B | Invention |
| 3-11 | 7.0 | 0.2 | 40 | 0.50 | A | 0.05 | B | Invention |
| 3-12 | 7.0 | 0.2 | 120 | 0.01 | DD | 0.05 | D | Comparison |
| 3-13 | 7.0 | 0.2 | 120 | 0.02 | DD | 0.05 | D | Comparison |
| 3-14 | 7.0 | 0.2 | 120 | 0.03 | D | 0.05 | C to D | Comparison |
| 3-15 | 7.0 | 0.2 | 120 | 0.05 | D | 0.05 | C to D | Comparison |
| 3-16 | 7.0 | 0.2 | 120 | 0.06 | D | 0.05 | C | Comparison |
| 3-17 | 7.0 | 0.2 | 120 | 0.10 | D | 0.05 | C | Comparison |
| 3-18 | 7.0 | 0.2 | 120 | 0.20 | D | 0.05 | C | Comparison |
| 3-19 | 7.0 | 0.2 | 120 | 0.25 | D | 0.05 | C to D | Comparison |
| 3-20 | 7.0 | 0.2 | 120 | 0.30 | D | 0.05 | C to D | Comparison |
| 3-21 | 7.0 | 0.2 | 120 | 0.35 | D | 0.10 | D | Comparison |
| 3-22 | 7.0 | 0.2 | 120 | 0.50 | D | 0.10 | D | Comparison |

Example 5

Stability of the pH during the running of processing was evaluated by making running experiments in the same manner as in Example 1, except that ammonium thiosulfate contained in the bleach-fixer tank solution and bleach-fixer replenishing solution was partly replaced by potassium thiosulfate and/or sodium sulfate so as to give potassium and/or sodium ion ratios in the total cations shown in Table 5.

In Table 5, the stability of the pH is rated as follows:

A: fluctuation of pH value during running experiment is within the range of ±0.2

A-B: fluctuation of pH value is within the range of ±0.3

B: fluctuation of pH value is within the range of ±0.5

As apparent from Table 5, the stability of the pH and stability in processing are both good when the content of potassium and/or sodium is not less than 25 mol % of the total cations. Particularly, a content not less than 50 mol % enhances the effect of the invention much more.

TABLE 5

| Experiment No. | Content of (Na + K) in the total cations (mol %) | K/Na ratio (mol %) | pH | $NH_4Br$ (mol/l) | Opening area ($cm^2/l$) | pH Stability |
|---|---|---|---|---|---|---|
| A-1 | 0 | — | 8.0 | 0.15 | 35 | B |
| A-2 | 0 | — | 8.0 | 0.15 | 35 | B |
| A-3 | 0 | — | 8.0 | 0.15 | 35 | B |
| A-4 | 10 | 100/0 | 8.0 | 0.15 | 35 | B |
| A-5 | 10 | 50/50 | 8.0 | 0.15 | 35 | B |
| A-6 | 10 | 0/100 | 8.0 | 0.15 | 35 | B |
| A-7 | 20 | 100/0 | 8.0 | 0.15 | 35 | B |
| A-8 | 20 | 50/50 | 8.0 | 0.15 | 35 | B |
| A-9 | 20 | 0/100 | 8.0 | 0.15 | 35 | B |
| A-10 | 25 | 100/0 | 8.0 | 0.15 | 35 | B - A |
| A-11 | 25 | 50/50 | 8.0 | 0.15 | 35 | B - A |
| A-12 | 25 | 0/100 | 8.0 | 0.15 | 35 | B - A |
| A-13 | 50 | 100/0 | 8.0 | 0.15 | 35 | A |
| A-14 | 50 | 50/50 | 8.0 | 0.15 | 35 | A |
| A-15 | 50 | 0/100 | 8.0 | 0.15 | 35 | A |
| A-16 | 80 | 100/0 | 8.0 | 0.15 | 35 | A |
| A-17 | 80 | 50/50 | 8.0 | 0.15 | 35 | A |
| A-18 | 80 | 0/100 | 8.0 | 0.15 | 35 | A |
| A-19 | 100 | 100/0 | 8.0 | 0.15 | 35 | A |
| A-20 | 100 | 50/50 | 8.0 | 0.15 | 35 | A |
| A-21 | 100 | 0/100 | 8.0 | 0.15 | 35 | A |

Example 6

Experiments 6-2 to 6-6 were carried out in the same manner as in Experiment 1-18 of Example 1 except that exemplified compound I-2, I-21, I-32, I-33, I-34 or hydroxyl amine was used in the place of N,N-diethylhydroxyl amine (I-1). Experiment 6-1 was repeat of Experiment 1-18. Results of the experiments are shown in Table 6.

TABLE 6

| Experiment No. | Compound | Unevenness in magenta image | Residual silver amount mg/100 $cm^2$ | Recoloring failure | Corrosiveness | Remarks |
|---|---|---|---|---|---|---|
| 6-1 | I-1 | A | 0.3 | 0.01 | A | The same as Ex. 1-18. |
| 6-2 | I-2 | A | 0.3 | 0.01 | A | |
| 6-3 | I-21 | A | 0.1 | 0.01 | A | |
| 6-4 | I-32 | A | 0.1 | 0.01 | A | |
| 6-5 | I-33 | A | 0.1 | 0.01 | A | |
| 6-6 | I-34 | A | 0.1 | 0.01 | A | |
| 6-7 | Hydroxyl amine | B | 0.5 | 0.01 | A | Color formation is disturbed |

The amount of residual silver were lowered in the samples each containing highly water soluble compound I-21, I-32, I-33 or I-34 and the effect of the invention was enhanced.

Example 7

Experiments 7-2 to 7-9 were performed in the same manner as in 1-21 of Example 1 except that Tinopal was replace by exemplified compound E-1, E-18, E-12, E-16, E-36, E-38, E-39 or E-40. Experiment 7-1 was repeat of Experiment I-21. Results of the experiments are shown in Table 7.

TABLE 7

| Experiment No. | Compound | Unevenness in magenta image | Residual silver amount mg/100 $cm^2$ | Recoloring failure | Corrosiveness | Remarks |
|---|---|---|---|---|---|---|
| 7-1 | Tinopal SFP | A | 0.3 | 0.01 | A | The same as Ex. 1-23. |
| 7-2 | E-1 | A | 0.5 | 0.01 | A | |
| 7-3 | E-8 | A | 0.5 | 0.01 | A | |
| 7-4 | E-12 | A | 0.5 | 0.01 | A | |
| 7-5 | E-16 | A | 0.3 | 0.01 | A | |
| 7-6 | E-36 | A | 0.3 | 0.01 | A | |
| 7-7 | E-38 | A | 0.3 | 0.01 | A | |
| 7-8 | E-39 | A | 0.3 | 0.01 | A | |
| 7-9 | E-40 | A | 0.3 | 0.01 | A | |

In Examples each containing highly water soluble fluorescent brightener Tinopal SFP, E-16, E-36, E-38, E-39 or E-40, the amounts of residual silver were lowered and the effect of the invention was enhanced.

What is claimed is:

1. A method for processing a silver halide color photographic light-sensitive material comprising the steps of developing a silver halide color photographic light-sensitive material which comprises silver halide grains substantially consisting of silver chloride, with a color developer, and bleach-fixing said developed light-sensitive material with a bleach-fixer containing a water soluble bromide salt in an amount of from 0.08 mole/l to 0.3 mol/l, a sulfite or a compound capable of releasing sulfite in an amount of 0.06 mol/l to 0.20 mol/l, and having a pH value of from 6.5 to 8.5 in a tank in which said bleach-fixer has a surface area opening to air of from 8 $cm^2/l$ to 100 $cm^2/l$.

2. The method of claim 1, wherein said bleach-fixer contains sodium ion or potassium ion in an amount of not less than 25 mol % of the total amount of cations contained in said bleach-fixer.

3. The method of claim 1, wherein said surface area opening to air of said bleach-fixer in said bleach-fixing tank is 13 $cm^2/l$ to 80 $cm^2/l$.

4. The method of claim 1, wherein said color developer contains a compound represented by formula I;

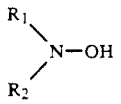

(I)

wherein $R_1$ and $R_2$ are each a hydrogen atom or an alkyl group, provided that $R_1$ and $R_2$ are not hydrogen atoms at the same time, $R_1$ and $R_2$ may be bonded to form a ring.

5. The method of claim 1, wherein said color developer contains a bis-trazinyl stylbene type brightning agent represented by the following formula;

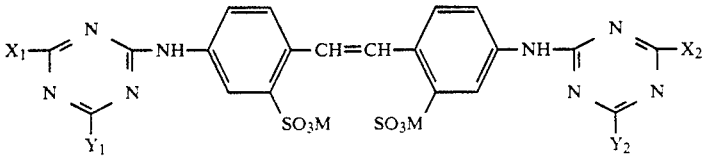

wherein $X_1$, $X_2$, $Y_1$ and $Y_2$ are each a hydroxy group, a halogen atom, an alkyl group, an aryl group,

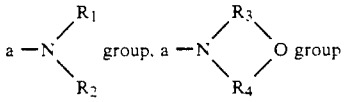

or a —$OR_5$ group, in which $R_1$ and $R_2$ are each a hydrogen atom, an alkyl group or a an aryl group; $R_3$ and $R_4$ are each an alkylene group; $R_5$ is a hydrogen atom, an alkyl group or an aryl group, and M is a cation.

6. The method of claim 1, wherein said bleach-fixer is replenished with a bleach-fixer replenisher in a rate of from 20 ml to 100 ml per square meter of processed light-sensitive material.

7. The method of claim 6, wherein said rate is 25 ml to 60 ml per square meter of processed light-sensitive material.

8. The method of claim 3, wherein said bleach-fixer contains sodium ion or potassium ion in an amount of not less than 25 mol % of the total amount of cations contained in said bleach-fixer.

9. The method of claim 8, wherein said surface area opening to air of said bleach-fixer in said bleach-fixing tank is 25 to 50 $cm^2/l$.

10. The method of claim 1 wherein said surface area opening to air of said bleach-fixer in said bleach-fixing tank is 25 to 50 $cm^2/l$.

11. The method of claim 5, wherein said color developer contains a compound represented by formula I;

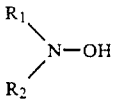

(I)

wherein $R_1$ and $R_2$ are each a hydrogen atom or an alkyl group, provided that $R_1$ and $R_2$ are not hydrogen atoms at the same time, $R_1$ and $R_2$ may be bonded to form a ring;

said bleach-fixer is replenished with a bleach-fixer replenisher in a rate of from 20 ml to 100 ml per square meter of processed light-sensitive material; and said surface area opening to air of said bleach-fixer in said bleach-fixing tank is 13 $cm^2/l$ to 80 $cm^2/l$.

12. The method of claim 11, wherein said surface area opening to air of said bleach-fixer in said bleach-fixing tank is 25 to 50 $cm^2/l$.

* * * * *